US006402294B2

(12) United States Patent
Minowa

(10) Patent No.: US 6,402,294 B2
(45) Date of Patent: Jun. 11, 2002

(54) PRINTER, PRINTING METHOD, AND DATA STORAGE MEDIUM

(75) Inventor: Masahiro Minowa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/746,576

(22) Filed: Dec. 22, 2000

(30) Foreign Application Priority Data

Dec. 27, 1999 (JP) ..... 11-371200

(51) Int. Cl.[7] ..... B41J 23/00; B41J 29/393
(52) U.S. Cl. ..... 347/37; 347/19
(58) Field of Search ..... 347/37, 19; 346/139 D

(56) References Cited

U.S. PATENT DOCUMENTS 6,145,980 A * 11/2000 Wang ..... 347/104

FOREIGN PATENT DOCUMENTS

| | | |
|---|---|---|
| JP | 62-104756 | 5/1987 |
| JP | 2000-272175 | 10/2000 |

* cited by examiner

*Primary Examiner*—Thinh Nguyen
(74) *Attorney, Agent, or Firm*—Rosalio Haro

(57) ABSTRACT

A printer and printing method suitable for high speed multicolor printing. A paper transport section (112) advances the printing medium (113), and a print head (110) prints text or graphics on the printing medium (113) by driving printing elements corresponding to a plurality of colors. A transport unit (111) moves the print head (110) orthogonally to the direction in which the printing medium (113) travels. A plurality of image buffer units (109) store information indicating where the printing elements are driven. A logic device (102) performs a logic operation on information read from image buffer units (109) to detect whether at least one of the printing elements is driven at a particular dot column position. A logic operation results memory (114) stores the logic operation results correlated to a print head (110) position. Using the information stored in the logic operation results memory (114), a print head movement range calculator (102) determines the range of print head (110) movement, and a movement controller (102) drives a the transport unit (111) to move the print head (110) in the obtained movement range.

58 Claims, 9 Drawing Sheets

PRINTER, PRINTING METHOD, AND DATA STORAGE MEDIUM

BACKGROUND OF THE INVENTION

1. Field of the Invention

The present invention relates to a printer, a printing method, and a data storage medium carrying a machine-readable computer program implementing the printing method.

2. Description of the Related Art

One type of color printer widely available today uses a print head having a plurality of printing elements each used to print a color different from the colorprinted by another printing element. This print head moves across a printing medium, such as paper, film, etc., orthogonally to the direction in which the printing medium is advanced. The printing elements are driven as required during this movement to print the desired text or image on the printing medium (referred to below simply as "paper"). Responding to a demand for higher print quality, the number of colors has increased. In addition to the common four-color CYMK (cyan, yellow, magenta, black) printers, printers using six colors, including light colors, to blend colors according to color density have even been proposed. Color printers of this type also use a variety of different print head types, including inkjet, thermal transfer, and dot impact type print heads.

Methods for achieving high speed printing with these color printers are also known. JP-B-4-28231, for example, teaches to count the number of times each printing element is driven, and to determine the range of print head movement based on the accumulated total. The problem with the method taught in JP-B-4-28231, however, is that the printing element drive count is accumulated for each color. This makes processing complicated. Applying this method, therefore, becomes increasingly difficult as the number of colors increases.

There is, therefore, a need to achieve high speed color printing without relying on such a counting method.

An object of the present invention is to provide a printer that drives plural printing elements during bidirectional movement and achieves high speed printing. Another object of the invention is to provide a printing method for said printer, and to a data storage medium carrying a computer-readable program achieving this printing method.

These objects are achieved with a printer as claimed in claim 1, a printing method as claimed in claim 22 and a storage medium as claimed in claim 25, respectively.

SUMMARY OF THE INVENTION

To achieve this object, our invention teaches a printer having a printing medium transportation section for transporting a printing medium; a print head having a plurality of printing element arrays disposed thereto with a specific physical offset therebetween, each printing element array having a plurality of printing elements; a head transportation unit for moving the print head in a print head scanning direction orthogonal to the direction in which the paper transportation section transports the printing medium; a plurality of image data storage units disposed in correlation to the plural printing element arrays for storing with correlation to a dot column position in the print head scanning direction drive data indicative of whether a printing element is driven or non-driven; a logic device for performing a logic operation on drive data stored in plural image data storage units correlated to the print head movement position, and calculating logic operation results for each print head movement position, said logic operation results indicative of whether at least one drive data for the print head movement position contains drive command data for driving one of the printing elements; a print head movement range calculator for obtaining print head movement range information identifying a print head movement range required to print drive data stored in an image data storage unit based on the logic operation results from the logic device; and a movement controller for driving the head transportation unit to move the print head in the print head movement range identified from the print head movement range information calculated by the print head movement range calculator.

Performing a logic operation correlated to a print head movement position is used herein for the following two cases: (1) correlating the drive data stored in the image data storage unit to a particular print head position based on the relationship to the position of a particular reference part of the print head (such as a particular printing element array) without considering the physical offset distance between this reference part and the other printing element arrays of the print head, and (2) correlating the drive data after compensating for the offset distance between this reference part of the print head and each of the other printing element arrays of the print head.

Logic information (logic operation results information) indicating if any drive data corresponding to the plural printing elements of a printing element array contains drive command data (indicating that a particular printing element is driven to print) can thus be simultaneously and easily obtained for all printing element arrays with the logic information correlated to each print head movement position. Furthermore, it is also possible to easily and quickly identify from this logic information the smallest physical range through which the print head must move in order to print the drive data. As a result, the printing speed (throughput) can be improved.

The logic device of this printer further preferably performs a logic operation on all drive data stored in the plural image data storage units correlated to the print head movement position in dot column units to calculate logic operation results for each print head movement position indicating if at least one of the drive data for that dot column is drive command data; and the print head movement range calculator determines the print head movement range by compensating the print head movement range detected from the logic operation results obtained by the logic device for the offset of the printing element array.

Logic operations are thus performed at each dot column position using all drive data corresponding to that dot column position. Because the drive data indicates whether the printing elements of the printing element array are driven at a particular dot column position, and drive data for each printing element array is stored in corresponding plural image data storage units, the horizontal range (that is, the range in the print head movement direction) in which image data of multiple colors is present can be easily determined. In addition, by compensating for the offset between printing element arrays by, for example, adding the offset between the printing element arrays for each color to the horizontal range of the image data, the smallest range through which the print head must move in order to print all image data can be easily and quickly identified. This contributes to further improvement in the printing speed.

The print head movement range calculator can also compensate for this offset by adding the maximum offset between the plural printing element arrays to the print head movement range detected from the logic operation results by the logic device. It is therefore possible to easily and quickly compensate for the offset between the printing element arrays for each of the printable colors.

Alternatively, the logic device of a printer according to the present invention compensates drive data for each dot column position stored in the plural image data storage areas according to the offset of each printing element array, performs a logic operation on the compensated drive data correlated to a print head position, and calculates logic results information indicative of whether drive command data for driving at least one of the plural printing elements of the plural printing element arrays is present at a particular dot column position as a logic value compensated for the printing element array offset at each print head movement position.

In this case the logic operation is performed after compensating for the offset between printing element arrays. As a result, it is not necessary for the print head movement range calculator to compensate for the offset between printing element arrays, unnecessary movement resulting from the printing element array offset can be prevented, and the printing speed can be increased accordingly.

Preferably, the logic device compensates for the offset amount by defining one of the plural printing element arrays as a reference printing element array correlated to a specific dot column position, and adds or subtracts a dot count equivalent to a physical offset from the reference printing element array; and calculates logic operation results at each print head movement position indicating whether the drive data corresponding to the print head movement position contains at least one drive command data by calculating as a compensated dot column position the position of a drive data array physically printable by a respective printing element array when the reference printing element array is at a dot position, and applying a logic operation to the reference printing element array drive data and drive data corresponding to the compensated dot column position stored in the image data storage units for the plural printing element arrays other than the reference printing element array. This makes it possible to set the most efficient reference position according to the print head arrangement or the properties of the data to be printed.

A computer-readable program achieving a printer and printing method according to the present invention as described above can be recorded on Compact Disc (CD), floppy disk, hard disk, magneto-optical disc, Digital Video Disc (DVD), or magnetic tape.

A computer-readable program achieving a printer and printing method according to the present invention as described above can also be placed on a network [World Wide Web] server for access via the Internet or other network so that users can download the program from the server for storage to printer ROM or other memory to update the printer driver. The program can then be run on the printer to achieve the control method of the present invention.

Other objects and attainments together with a fuller understanding of the invention will become apparent and appreciated by referring to the following description of preferred embodiments taken in conjunction with the accompanying drawings.

DETAILED DESCRIPTION

Embodiment 1

A first embodiment of a printer according to the present invention is described with reference to FIGS. 1 to 3.

Figure 3:
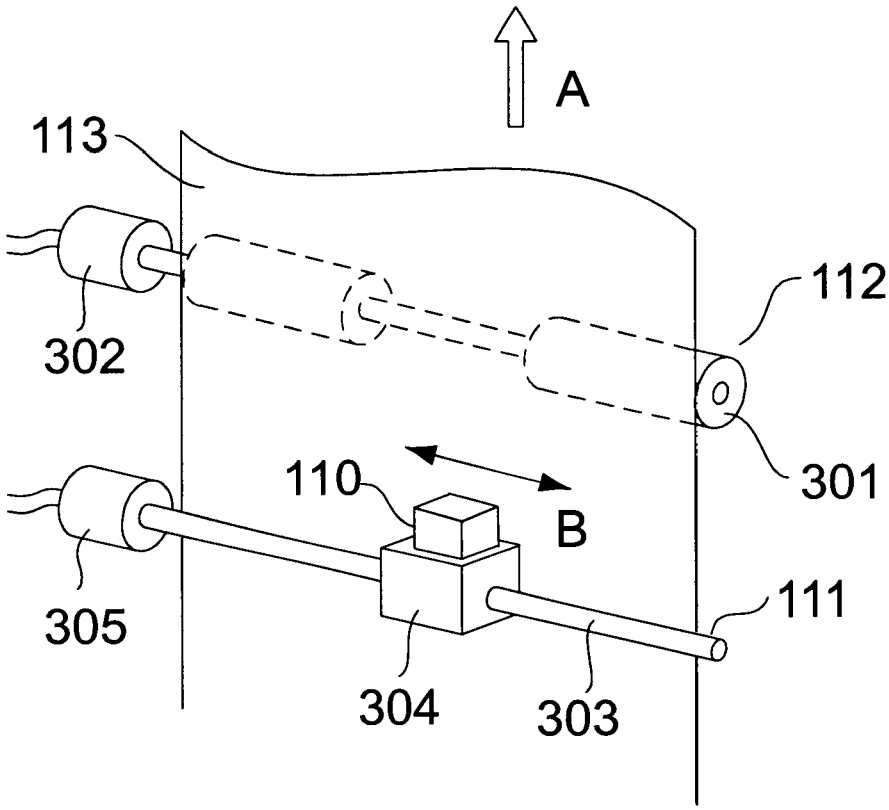
FIG. 3 shows the directions of print head movement and paper transport in the printer shown in FIG. 1.

As illustrated in FIG. 3, the printer prints by moving a print head 110 in two substantially orthogonal directions relative to the paper 113 which is to be printed. This two-dimensional movement may be achieved by reciprocating the print head 110 in a first scanning direction, indicated by the double arrow B, and advancing the paper 113 in a second scanning direction, indicated by arrow A. Typically but not necessarily, the first scanning direction is the horizontal direction along the width of the paper whereas the second scanning direction is the vertical direction along the length of the paper. The first scanning direction will, therefore, also be referred to as H-scanning direction and the second as V-scanning direction although this is not meant to impose any restriction other than that the two scanning directions are substantially perpendicular to each other.

A first or H-transport mechanism 111 for reciprocating the print head 110 in the direction B comprises a carriage 304 carrying the print head 110, a drive shaft 303 having a spiral groove (not shown in the figure) formed therein, and a carriage motor 305 for turning the drive shaft 303. The carriage is rotatably mounted on the drive shaft so as to be slidable along the drive shaft and is engaged with the spiral groove. When drive shaft 303 turns, carriage 304 moves in one or the other of the two opposite directions of arrow B depending on whether the drive shaft turns clockwise or counterclockwise. The print head 110 can thus be reciprocated across the width of the paper 113. Depending on whether a particular embodiment is capable of printing only during one or during both of the two directions of print head motion, one line can be printed in each cycle of the print head's reciprocative motion, or two lines can be printed in cycle, one during the forward run and the other during the return run.

A second or V-transport mechanism 112 functions as a printing medium transport section, and comprises a transport roller 301 and paper feed motor 302 for driving the transport roller 301. The transport roller is arranged so that its rotation feeds the paper, or other printing medium, in the V-scanning direction A.

Figure 2:
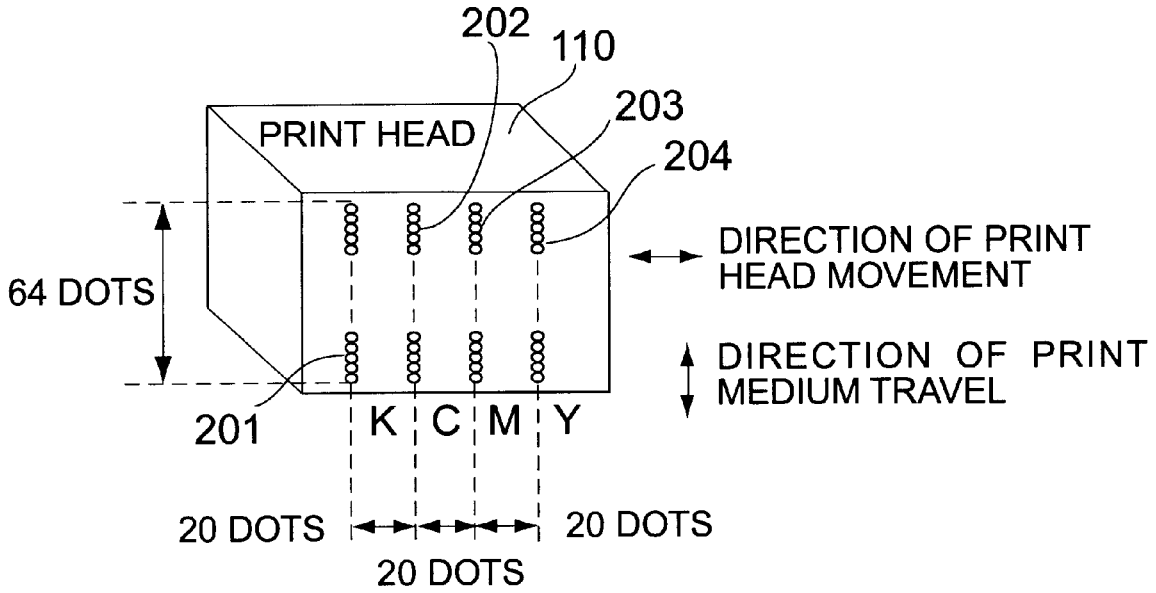
FIG. 2 shows the print head in the printer shown in FIG. 1.

As shown in FIG. 2, on its side facing the paper 113, print head 110 has four arrays of printing elements 201, 202, 203, and 204. The arrays are arranged side by side with a certain dot interval di in the H-scanning direction B. The four arrays 201, 202, 203, and 204 correspond to four different colors, such as black (K), cyan (C), magenta (M), and yellow (Y), respectively, that are available for printing in this exemplary embodiment of the invention. If a particular printer is to use more or less than four different colors, the number of arrays of printing elements could be increased or decreased correspondingly. Each array contains a specified number $N_{pe}$ of printing elements arrayed in the V-scanning direction A with a certain dot pitch dp. Typically, the dot pitch dp and the number $N_{pe}$ of printing elements is the same for all arrays (four arrays, in this embodiment). The printing elements are thus arrayed perpendicularly to the H-scanning direction. It should be noted, however, that the printing elements are not necessarily perfectly perpendicular to the H-scanning direction, rather the arrays can form an angle smaller than 90° with the H-scanning direction. Furthermore, it will be appreciated that FIG. 2 shows the front side of the print head, i.e., the side facing the paper 113. Thus, in FIG. 3 the array 204 faces the left end of the print head's stroke while array 201 faces the right end.

The arrays 201 to 204 are spaced at an equal dot interval di, which is equivalent to 20 dots in this embodiment. Hence, the offset between the first array 201 and the last array 204 is equivalent to 60 dots. The number $N_{pe}$ of printing elements in each array is $N_{pe}$=64 in this embodiment, and the dot pitch dp equals 360 dpi (dp=14.2 dots per mm). In addition, the print head typically prints at the same dot pitch in the H-scanning direction. Assuming a paper width w of about 200 mm (A4 size), this print head can thus print a maximum of 2840 dots per printing line in the H-scanning direction. The number of printing elements corresponding to $N_{pe}$ dots is equivalent to the height of one printing line (in the V-scanning direction). It is to be noted that the particular values of the dot pitch dp, the dot interval di, the paper width w, and the number $N_{pe}$ are not essential for the invention in its broadest aspect, and the values should thus be understood as exemplary only.

The scanning motion of the print head relative to the paper in the H-scanning direction corresponds to a printing line and defines a matrix of dot positions on the paper (referred to as "dot position matrix" hereinafter). Based on the exemplary values mentioned above, the matrix has a length (number of columns) of dp*w=14,2*200=2840 dot positions in the H-scanning direction and a height (number of rows) of $N_{pe}$=64 dot positions in the V-scanning direction. By the additional scanning in the V-direction a plurality of such matrices is defined, one next to the other in the V-direction. It should be understood that the term "dot position matrix" as used in this text refers to possible dot positions on the paper and defines the position of a printing line on the paper in the V-scanning direction. A "printing line" comprises those dot positions of a dot position matrix at which a dot is to be or has actually been printed.

While the present invention is applicable to a variety of printing technologies, such as inkjet printing, thermal transfer printing an impact printing, in the preferred embodiments the invention is applied to an inkjet printer. In case of an inkjet printer, the printing elements are nozzles for ejecting ink droplets. The arrays of printing elements will be referred to as nozzle arrays hereinafter.

Figure 1:
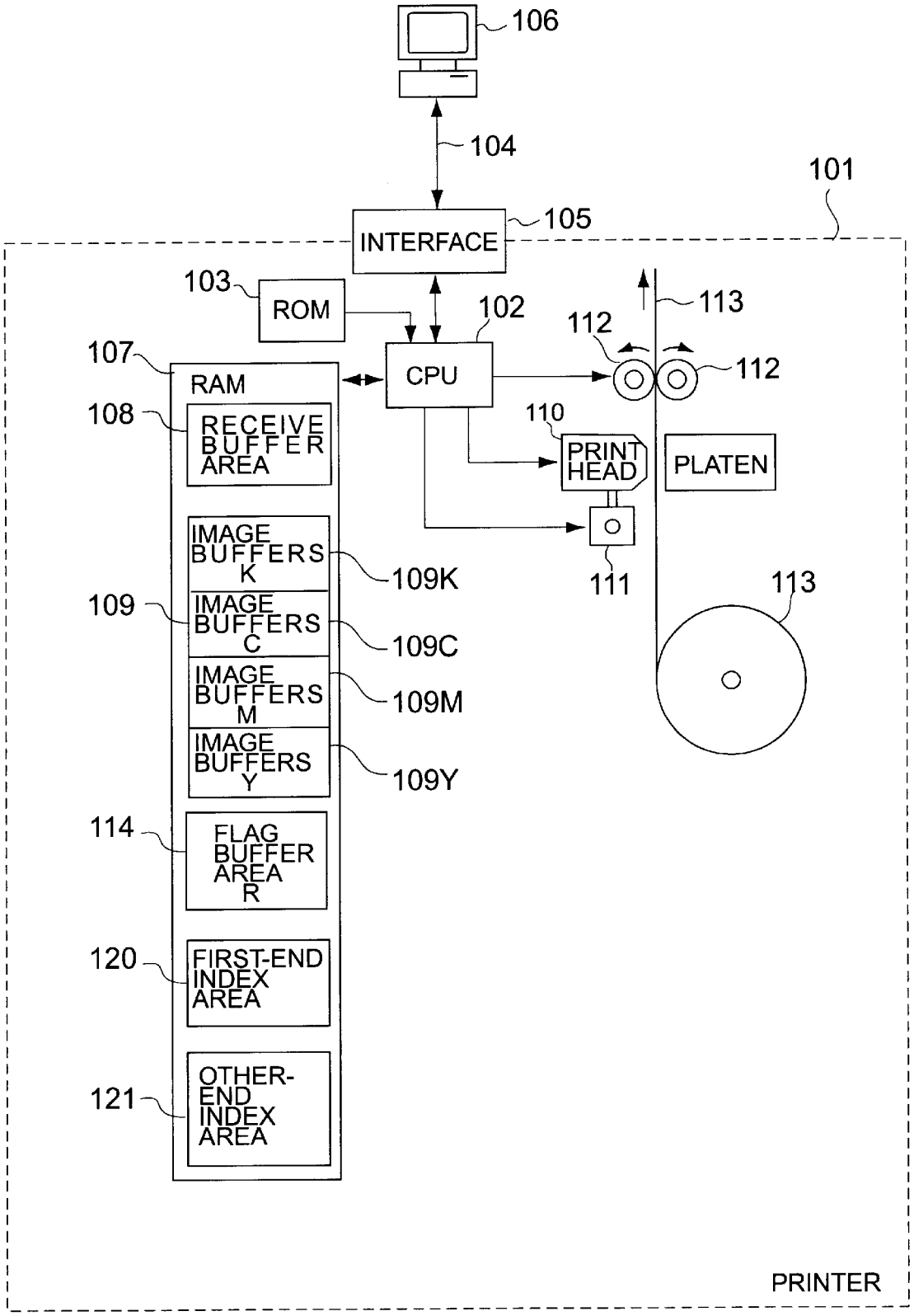
FIG. 1 is a block diagram of a printer according to a first embodiment of the present invention.

An exemplary printer configuration according to the present invention will now be described with reference to FIG. 1 showing a block diagram of a printer 101 connected to a host device 106. In FIG. 1, paper 113 is shown to be roll paper drawn off a paper roll 113'. It will be appreciated that the use of roll paper is not essential to the invention and any type of cut-sheet paper or other printing medium may be used instead.

A CPU 102 controls the various parts of the printer 101. The program run by CPU 102 to control these various parts is stored in ROM 103. When the printer 101 is turned on or is reset, CPU 102 reads and sequentially executes this program. The printer 101 communicates with host device 106 by means of a communication line 104 and an interface 105. When data sent from the host device 106 is received, an interrupt is issued to the CPU 102, and a receive interrupt process is started. The receive interrupt process sequentially stores the received data in a receive buffer 108 in a FIFO (first in, first out) order, and then returns to the normal control process.

If the receive buffer 108 is full, the host device 106 is so notified and the receive interrupt process ends. This notification is accomplished by the normal control process sending a busy signal, for example. When space is again available in receive buffer 108, the printer 101 so notifies the host device 106 and, in response to the data transfer being resumed, the receive interrupt process is started again.

The CPU 102 reads the data stored in receive buffer 108 in a FIFO manner during the normal control process, detects the type of command or print data contained in the received data, and runs processes corresponding to the received data type.

If the stored data is a print command for printing text or images, a corresponding bitmap image is developed and temporarily stored in an image buffer 109. In case of text, the bitmap is created on the basis of font data read from ROM 103. The bits in the bitmap image have a one-to-one relation with the dot positions of the dot position matrix mentioned earlier.

In the present embodiment of a four-color printer, the image buffer 109 comprises four buffer units shown as buffer units 109K, 109C, 109M, and 109Y. Each buffer unit corresponds to one of the four colors. In other words, four bitmap images are created, one for each color. Each buffer unit is subdivided into buffer segments. The number of buffer segments in each buffer unit corresponds to the number $N_{pe}$ divided by the data-word length of the CPU 102 (also referred to as CPU data processing unit). For example, in case of a 16-bit CPU (data-word length equals 16 bits) and the assumed $N_{pe}$=64, four buffer segments are used. With a 32-bit CPU only two buffer segments per buffer unit and with an 8-bit CPU 8 buffer segments per buffer unit would be required. The bitmap image stored in each buffer unit can be considered as comprising 2840 64-bit words (dp*w=2840 words of $N_{pe}$=64 bits each). In case of the 16-bit CPU, each word comprises four sub-words stored in the four buffer segments, respectively. Each word includes the bitmap data for one dot position column of the dot position matrix. In the following description it is assumed a "1" bit means a dot is to printed (ink ejection) at the corresponding dot position, whereas a "0" bit means that no dot is to be printed (no ink ejection). As will be appreciated by those skilled in the art, the invention is likewise applicable to the opposite case, i.e., a value "0" means a dot is to printed and a value "1" means no dot is to be printed.

When the bitmap data for one printing line have been developed in the image buffer 109, or a carriage return command is received, CPU 102 drives the H-transport mechanism 111 to move the print head 110 while also driving the individual nozzles of the print head 110 to print according to the bitmap data stored in the image buffer 109. Text or images can thus be printed in multiple colors on paper 113.

Before actually driving the H-transport mechanism 111, CPU 102 calculates the two line end positions, namely the line start and stop positions, of the printing line within the dot position matrix (this will be referred to as "end position calculation"). A printing line does not always extend over the whole length of the dot position matrix. In case of text printing, for instance, the text comprises long and short lines, lines with left or right justification etc. The printing speed can be enhanced by preventing the print head to scan parts of the dot position matrix in which no dot is to be printed. In accordance with the present embodiment of the invention, the required range of motion of print head 110 to print a certain printing line, i.e., the start and stop positions of the printing line, is obtained from a logic operation on the bitmap data stored in image buffer 109. The result of this logic operation is stored in a flag buffer 114. This flag buffer indicates for each column of the dot position matrix whether a dot is to be printed in that column or not. The range of movement is obtained from a start position register or memory 120 and a stop position register or memory 121. This is described more fully further below. It is to be noted that "start position" and "stop position" are just labels denoting the two end positions of a respective printing line; these labels do not exclude printing to start at the "stop position" and end at the "start position".

After printing one line is completed, CPU 102 drives the V-transport mechanism 112 to advance the paper.

Taking the exemplary values described above, the printing range corresponds to the length of the dot position matrix (w≈200 mm), i.e., it is equivalent to 2840 dots position columns. However, because the four nozzle arrays are spaced apart from one another by the dot interval di (20 dots), a stroke equivalent to 2840+60 dots is required for the print head to cover that printing range with each of the four nozzle arrays.

Image buffer 109 stores 64*2840/8=8*2840 bytes for each color. Because the present embodiment is assumed to print with four colors (CMYK) of ink, the total byte capacity of image buffer 109 is 8*2840*4 bytes.

End position calculation

Figure 4:
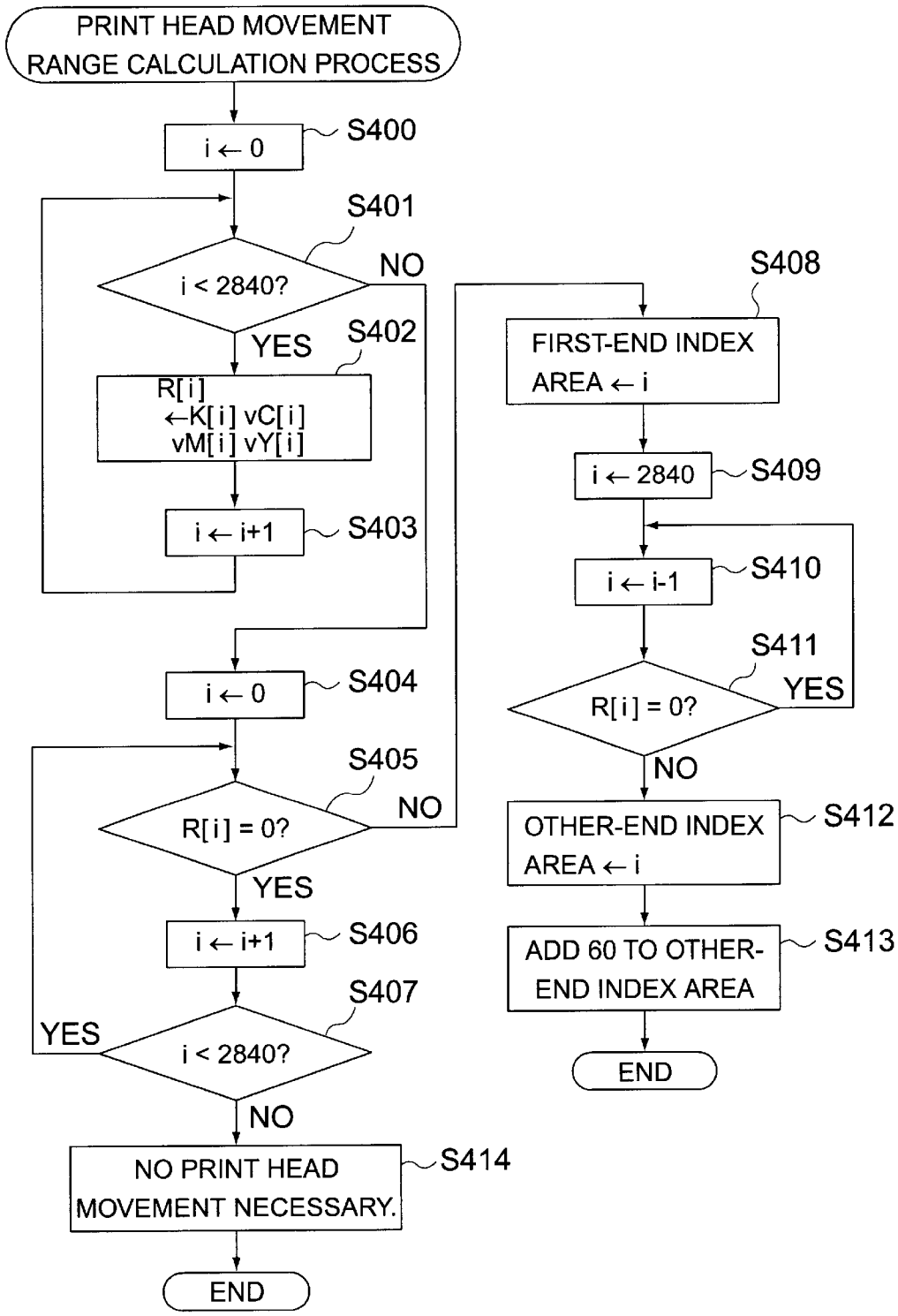
FIG. 4 is a flow chart of the end position calculation process used in the printer shown in FIG. 1.

FIG. 4 is a flow chart of the end position calculation process for obtaining the line start and stop positions of a particular printing line in this first embodiment. It should be noted that, as described above, this process is executed after:

(1) the printer interface detected receipt of data from host device 106, (2) the detected data have been received in the receive interrupt process and stored in receive buffer 108, (3) the data have been sequentially read from receive buffer 108 in the normal control process, (4) CPU 102 generated a bitmap image in image buffer 109, and (5) the complete bitmap image for one line has been stored in image buffer 109, or a command instructing the printer to print has been received by CPU 102.

Index i denotes the column position in the dot position matrix; at the same time, i addresses the corresponding 64-bit word in each of the buffer units 109K to 109Y. Hence, K[i], C[i], M[i], Y[i] indicate the i-th 64-bit words in buffer unit 109K, 109C, 109M and 109Y, respectively. When the first dot column position is represented by i=0, index i has a range from 0 to 2839.

When the process starts, CPU 102 sets index i to 0, i.e., it resets a column counter which may be a register, an area in RAM 107, or another temporary storage) (step S400), and then detects whether i<2840 (step S401).

If i<2840 (step S401 returns Yes), the logical sum (OR) of respective 64-bit words K[i], C[i], M[i] and Y[i] in buffer units 109K to 109Y, respectively, is calculated, and the result is stored in flag buffer 114 (step S402). Denoting the logical sum with R[i], then R[i]=K[i] v C[i] v M[i] v Y[i]. Note that the logical product (NAND) is calculated in case of the above mentioned alternative that "0" bits, rather than "1" bits, in the bitmap data indicate dots to be printed.

The value of i is then incremented (i=i+1) (step S403), and the procedure loops back to S401.

Figure 5:
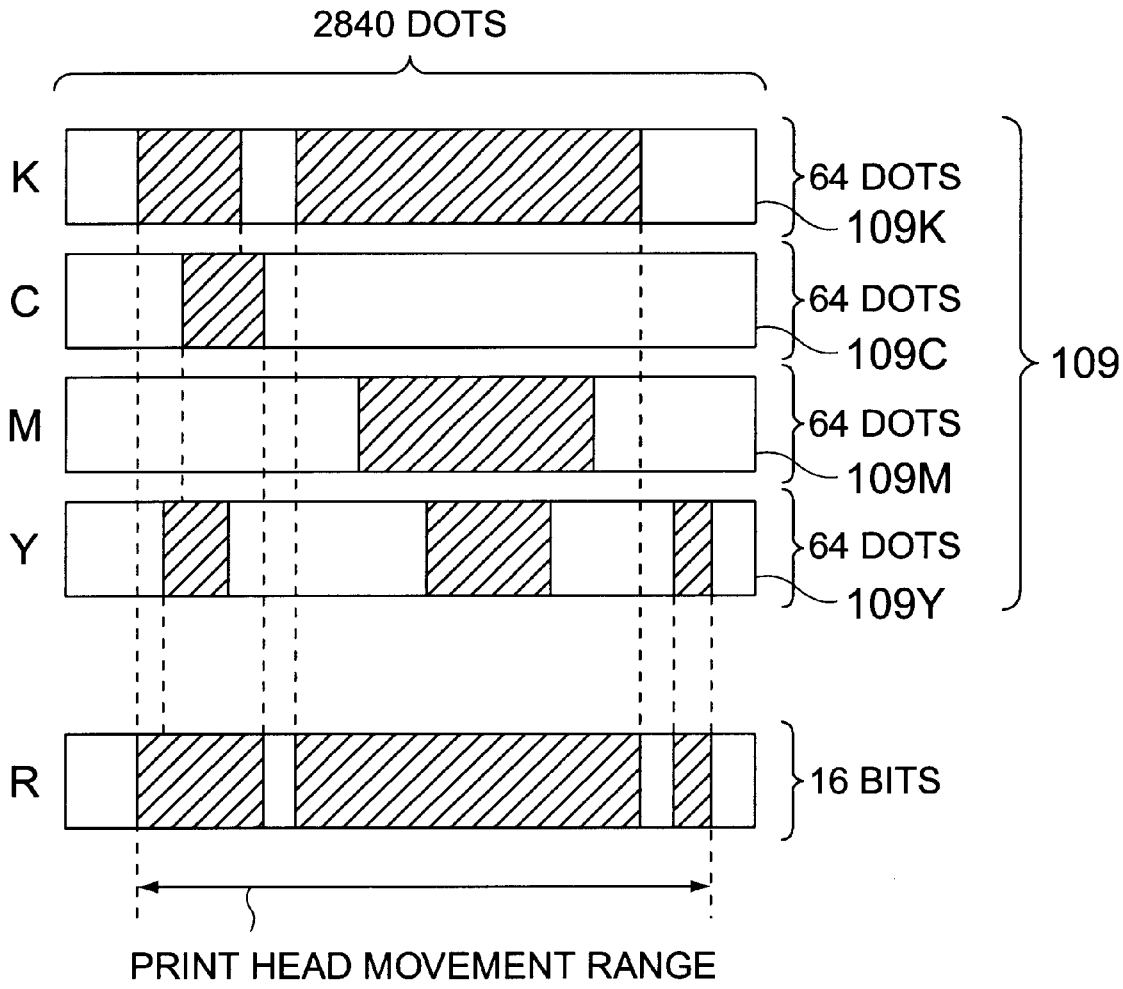
FIG. 5 shows the image buffer units and the flag buffer in the process shown in FIG. 4.

FIG. 5 shows image buffer 109 and flag buffer 114 after completing the logical sum calculations by repeating steps S401 to S403. These buffers all store 2840 words. The word length is $N_{pe}$=64 bits in case of the image buffer 109, while it is X bits in case of the flag buffer 114. Logic operations are performed in units of the CPU's data-word length. An 8-bit CPU therefore performs these operations in 8-bit units, and a 16-bit CPU operates in 16-bit units. The flag buffer 114 only needs to store the final result of the logical sum calculation to indicate whether there is an "1" bit in any of the 64-bit words addressed by index i in buffer units 109K to 109Y. The flag buffer 114, therefore, does not need to store 64 bits per dot position column i. Rather it is possible to segment the 64 bits by the data-word length of the CPU, obtain the logical sum of each segment, and only store the result of this logic operation. For example, with a 16-bit CPU and four buffer segments per color for a word length of 64 bits, the result stored in flag buffer 114 for each color can be compressed to a total of X=16 bits each representing the logical sum of a respective one of the 4*4 buffer segments. In this case, the capacity of flag buffer 114 needs to be only 16 bits×2840 dot position columns or 2*2900 bytes.

By further obtaining the logical sum of those resulting 16 bits 1-bit data for each column in the dot position matrix can be stored. In this case, the capacity of the flag buffer 114 can be reduced to 1*2840 bits even if the operation results are stored for an entire line. A value of "1" of such 1-bit data means there is at least one dot in at least one color to be printed in the respective dot position column.

The hatched areas in FIG. 5 indicate columns of the dot position matrix at which any one of the 64 ink nozzles for a particular color is to be driven. The logical sums of the data stored in image buffer 109 is obtained and stored in flag buffer 114. The hatched areas in the buffer units of image buffer 109 result in corresponding hatched areas in flag buffer 114 and indicate that one of the nozzles is to be driven.

When step S401 returns No, i is reset to 0 (zero) (step S404), and step S405 detects whether R[i]=0. If R[i]=0 (step S405 returns Yes), i is incremented by 1 (step S406) and step S407 detects whether i<2840. If it is (step S407 returns Yes), the procedure loops back to S405.

However, if R[i]≠0 (step S405 returns No), the current value of index i represents the line start position, i.e., the i-th column in the dot position matrix is the first to include at least one dot position at which a dot is to be printed. The current value of i is stored in the start position memory 120 (step S408).

Index i is then set to 2840 (step S409) and decremented by 1 in step S410; step S411 detects whether R[i]=0. If it is (step S411 returns Yes), the procedure loops back to S410. If R[i]≠0 (step S411 returns No), the current value of i represents the line stop position, i.e., the i-th column in the dot position matrix is the last one to include at least one dot position at which a dot is to be printed. The current value of i is stored in the stop position memory 121 (step S412).

The value of i stored in the stop position memory 121 is then increased by 60 (step S413), and then this process ends. Adding 60 (=3*di) to the obtained line stop position accounts for the distance between nozzle array 201 and nozzle array 204 requiring the print head to move by this distance beyond the length that corresponds to the difference between the line start and stop positions.

On the other hand, if i>=2840 in step S407 (step S407 returns No), a value indicating that it is not necessary to move the print head 110 is stored in both the start position memory 120 and the stop position memory 121 (step S414), and this process ends. A value indicating that it is not necessary to move the print head 110 can be a value, such as 4000, that is greater than the greatest value (2840+60=2900) otherwise stored in memories 120 and 121.

Figure 6:
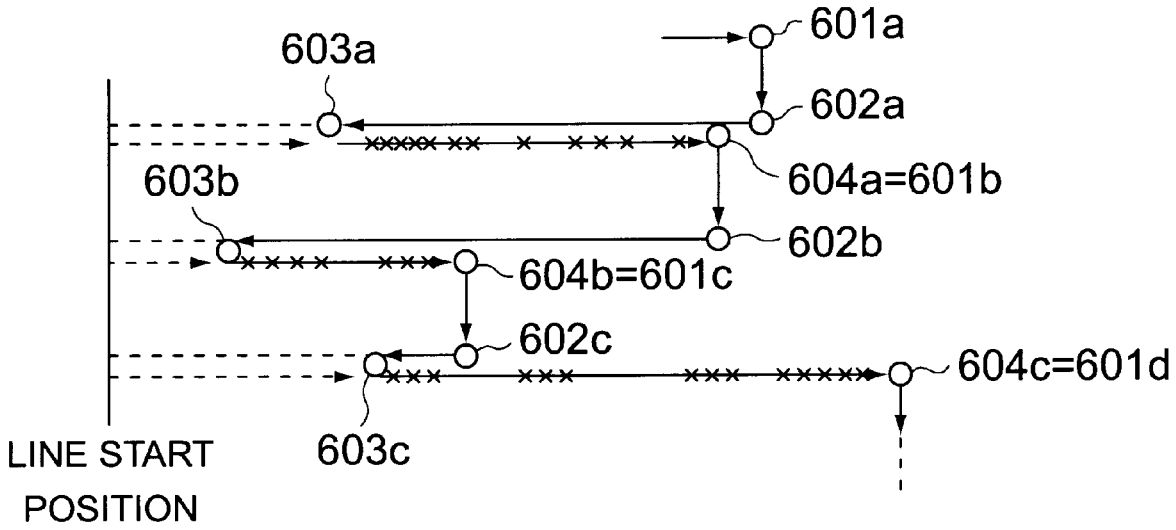
FIG. 6 shows the path of print head movement relative to the paper in the printer shown in FIG. 1.

FIG. 6 shows the movement of print head 110 relative to the paper 113 when the movement is controlled based on line start and stop positions as described above. It should be noted that printing occurs only in one direction in this example. Note, further, that reference numerals 601*a*, 601*b*, 601*c* and so forth are collectively referred to by reference numeral 601 below.

When print head 110 reaches the position 601, the line stop position of the previous printing line, V-transport mechanism 112 advances the paper 113 to the position of the next printing line. This positions the print head 110 at position 602. The above-described receive interrupt process, normal control process, and end position calculation are then appropriately accomplished to detect the line start and stop positions of the next printing line. The print head 110 is then moved to position 603, that is, the line start (left end) position of the printing line.

The nozzle arrays 201 to 204 in print head 110 are then appropriately driven to print the text or image in color as the print head is moved towards the line end (right end) position 604. The locations at which one or more of the nozzle arrays 201, 202, 203, and 204 is driven are indicated by x's in FIG. 6. Once the print head 110 reaches position 604, CPU 102 stops driving the carriage motor 305 and proceeds to process the next line.

FIG. 6 also compares the range of motion of print head 110 in a printer 101 according to the present invention with that of the printer disclosed in JP-B-4-28231. As indicated in FIG. 6 and explained above, in accordance with the invention, the print head moves between line start and stop positions. In contrast to this, in the known printer, the print head always returns to the start position of the printing range (which would correspond to i=0 in the description above) and starts its scanning motion at that position as indicated by the phantom lines in FIG. 6. It will be appreciated that a printer according to the present invention can print faster because movement in an area where nothing is printed as indicated by the phantom lines can be avoided.

Like the printer disclosed in JP-B-4-28231, a printer according to the present invention can be made to move the print head 110 to the start position of the printing range rather than the line start position each time a line is printed. In this case, only the line stop position needs to be obtained by the end position calculation. While a printer thus comprised will not achieve the same increase in printing speed as in the case described above, it will still be advantageous compared to the prior art of JP-B-4-28231 in that the line stop position is obtained by a simple logic operation. This contributes to increasing the printing speed and simplifying the control process. It should be noted that steps S404 to S408 in the process of FIG. 4 can be omitted in this case, and an appropriate termination process (determining whether i>=0, and, if not, ending the process) can be appended to steps S409 to S412.

Figure 7:
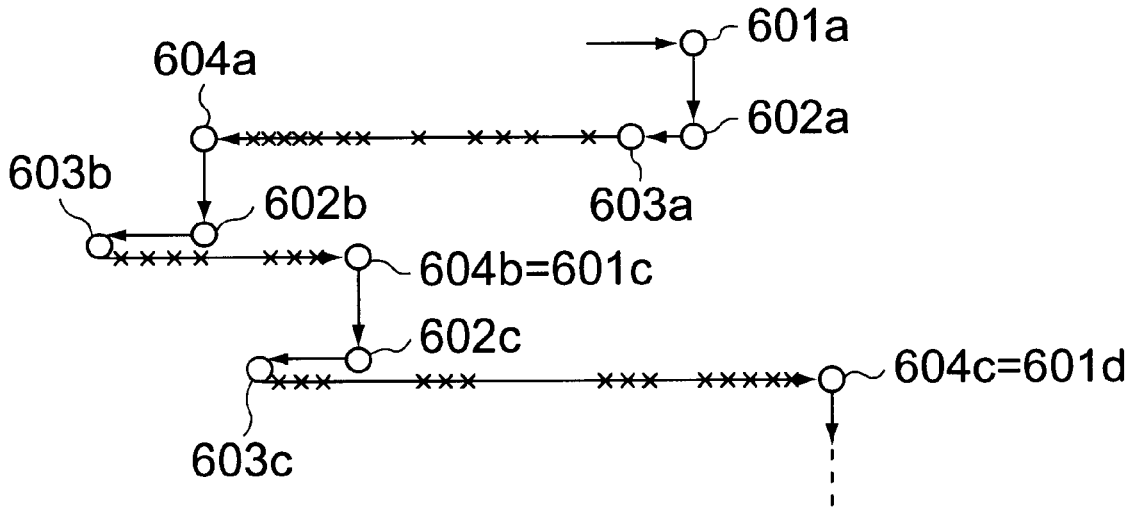
FIG. 7 shows the path of print head movement relative to the paper in the printer shown in FIG. 1.

FIG. 7 shows the motion of print head 110 relative to paper 113 in a printer capable of printing in both directions. FIG. 7 is otherwise identical to FIG. 6 and uses the same reference numerals. When the paper is advanced to position print head 110 at position 602, after the print head reached line stop position 601 of the previous printing line, CPU 102 determines whether the print head 110 is closer to the line start or the line stop position of this next printing line, and moves the print head to the closer one of these to positions (line stop position 603 in the illustrated example). The print head 110 is then moved from this nearer one to the more distant one of those two line end positions (line start position 604 in the illustrated example) while printing the text or image. These steps are simply repeated at each line.

A printer thus comprised achieves an even higher speed printing than a printer that operates as shown in FIG. 6.

Whether one-way printing from the line start position to the line stop position (or vice versa), one-way printing from the start position of the printing range to the line stop position, or two-way printing between the two line end positions is used can be appropriately selected according to the desired print quality.

As shown in FIG. 1, the receive buffer 108, the buffer units 109K to 109Y of the image buffer, the flag buffer and the start position and stop position memories 120 and 121 are implemented as respective areas in RAM 107 in this embodiment. It will be appreciated that the particular implementation of these buffers/memories is not critical to the present invention.

Embodiment 2

In the first embodiment, step S413 adds an amount of 3*di (60 dots) to the line stop position in memory 121 that is obtained from the end position calculation. As explained, this compensates for the distance between the two outermost nozzle arrays 201 and 204. The second embodiment differs from the first one in that step S413 is made unnecessary.

In the first embodiment, the logical sum (or product) is obtained from each group of 64-bit words that control printing or not printing at the same dot column position (i.e., the same position on the paper) but different positions of the print head. The print head's position is assumed to be i=0 when the ink nozzles of the nozzle array 201 (black) are controlled based on the $i^{th}$ (i=0) word in buffer unit 109K. The print head's position is i=60 when the nozzle array 204 is controlled based on the $i^{th}$ (i=0) word in buffer unit 109Y. Hence, at a certain position i of the print head the nozzle array 201 is controlled based on the $i^{th}$ word in buffer unit 109K, nozzle array 202 is controlled based on the $(i-20)^{th}$ word in buffer unit 109C, nozzle array 203 is controlled based on the $(i-40)^{th}$ word in buffer unit 109M, and nozzle array 204 is controlled based on the $(i-60)^{th}$ word in buffer unit 109Y). In the second embodiment, the logical sum (or product) is obtained from each group of 64-bit words that control printing or not printing at the same position of the print head but, due to the offset between the nozzle arrays, different positions on the paper. Thus, while the first embodiment obtains line start and stop positions, the second embodiment obtains stroke start and stop positions, i.e., the two end positions of the stroke of the print head required to print a respective printing line.

Figure 8:
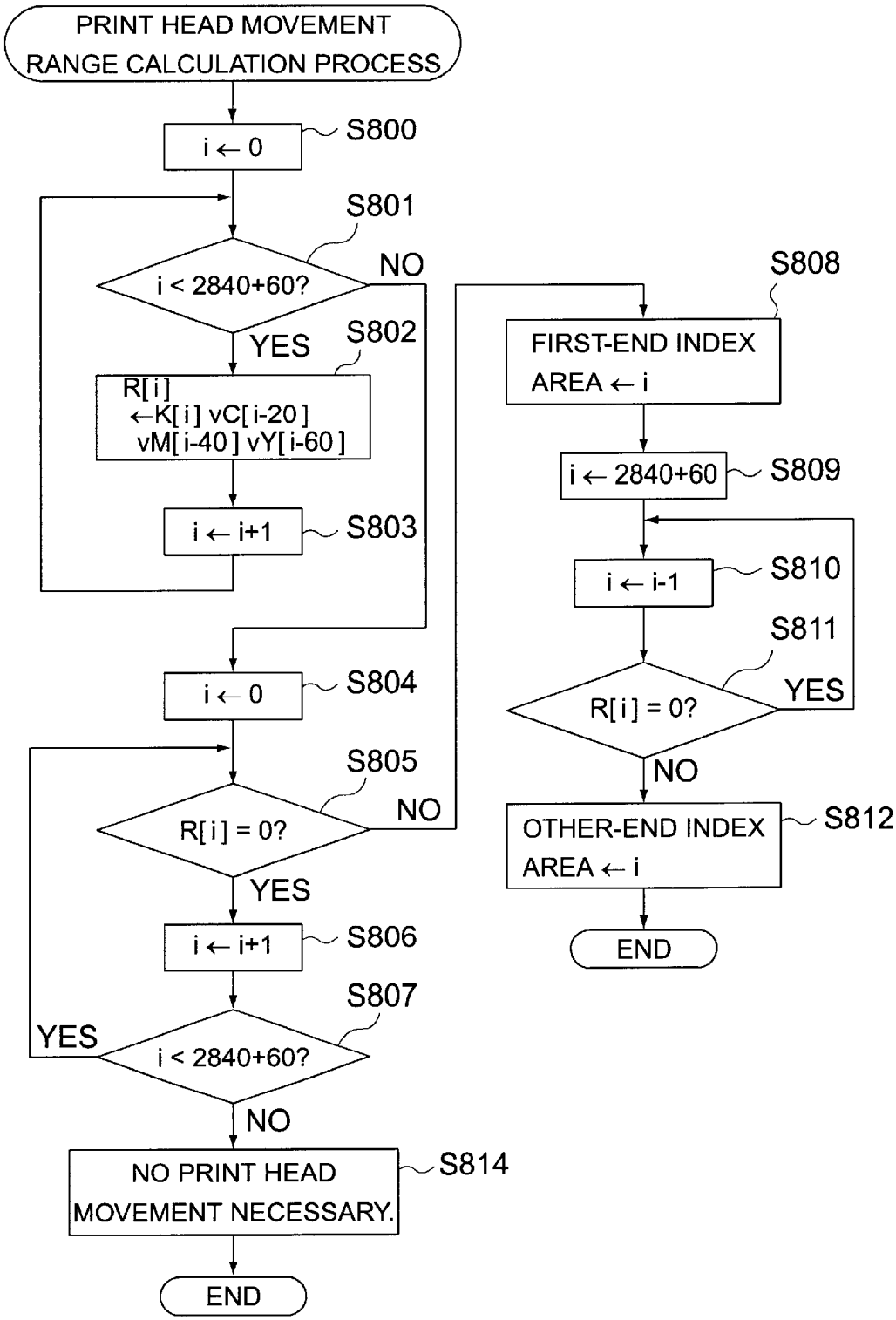
FIG. 8 is a flow chart of the end position calculation process according to a second embodiment of the present invention.

The second embodiment is described with reference to FIG. 8 showing a flow chart of the end position calculation process. Except for the differences mentioned below the structure of the first and second embodiments are the same and the same values of $N_{pe}$, dp, di and w will be used to explain the second embodiment.

CPU 102 first resets the index i to 0 (step S800), and then detects whether i<2840+60 (step S801). If i<2840+60 (step S801 returns Yes), the logical sum R[i]=K[i] v C[i−20] v M[i−40] v Y[i−60] is calculated and stored in the flag buffer 114.

In the first embodiment the i ranges from 0 to 2839 because the logical sum is established for each of the 2840 dot position columns of the position matrix. In the second embodiment i ranges from 0 to (2839+60) because the logical sum is established for each of the 2900 positions of the print head necessary in the example to have each of the four nozzle arrays positioned once at each of the 2840 dot position columns. The storage capacity of the buffer units 109K to 109Y is the same as in the first embodiment, namely 2840 words of 64 bits each. The storage capacity of the flag memory is different, however. In the second embodiment it is (2840+60) words of X bits each. X may be 16, 1 or another value as explained in the context of the first embodiment.

Figure 9:
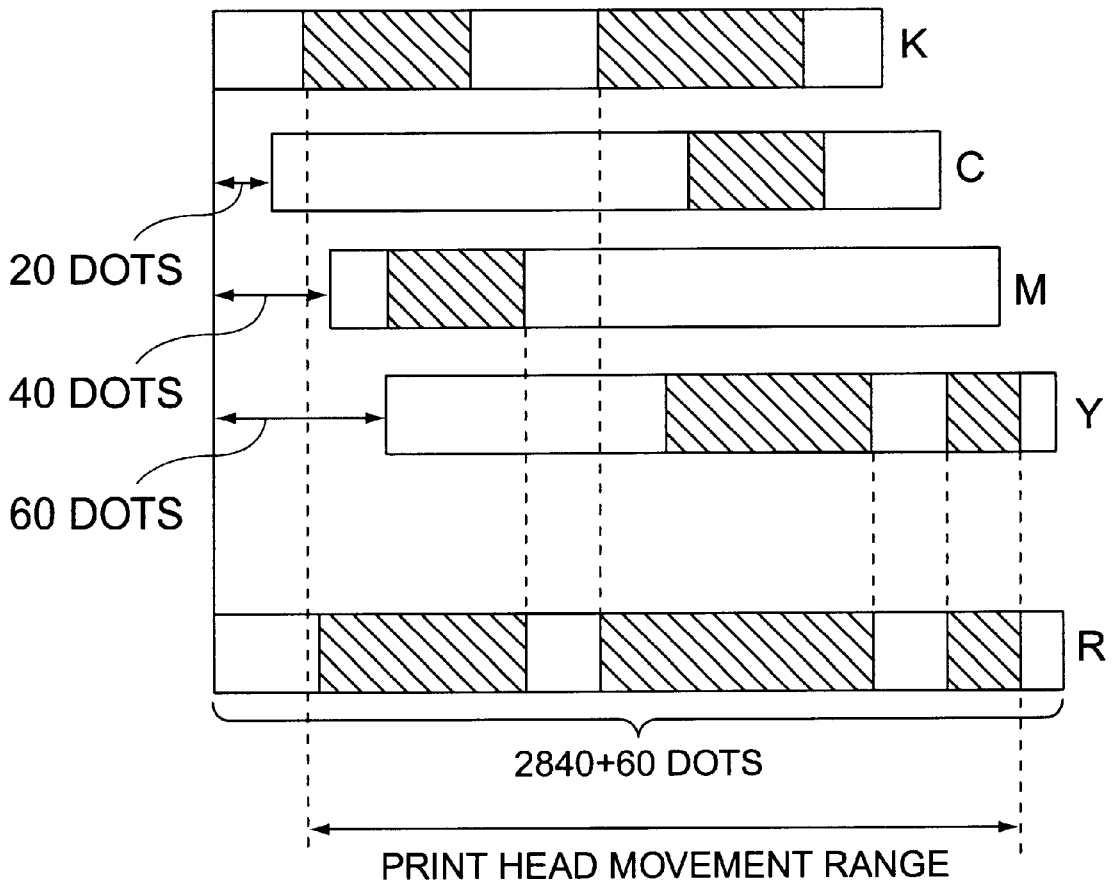
FIG. 9 shows the image buffer units and the flag buffer in the process shown in FIG. 8.

In the second embodiment, the buffer units 109K to 109Y are considered as being displaced with respect to one another by the same amount (number of dot positions) by which the respective nozzle arrays 201 to 204 are displaced from one another. This is illustrated in FIG. 9 which also shows that the flag buffer 114 spans the range from the left hand end of buffer unit 109K to the right hand end of buffer unit 109Y. It would be possible to have the capacity of each of the buffer units 109K to 109Y equal to that of the flag buffer (as regards the number of words that can be stored, not the word length). In such case the rightmost 60 words in buffer unit 109K, the first 20 words on the left hand side and the last 40 words on the right hand side of buffer unit 109C, the first 40 words on the left hand side and the last 20 words on the right hand side of buffer unit 109M, and the leftmost 60 words of buffer unit 109Y would be filled with "0"s ("1"s if "0" indicates a dot is to be printed). Instead of increasing the capacity of the buffer units in this way, a corresponding logic is preferably provided to return a value of 0 for the logical sum in a particular buffer unit if the value of index i is outside the range of indices of that buffer unit. For example, the 2840 words in buffer unit 109K corresponding to black are assigned addresses corresponding to $0 \leqq i \leqq 2839$, and K[i]=0 is returned for i>2839. In case of buffer unit 109C, addresses corresponding to $20 \leqq i \leqq 2859$ are assigned and C[i−20]=0 is returned for i<20 and for i>2859. This applies to M[i−40] and Y[i−60] in an analogous manner.

After step S802 i is incremented by 1 (step S803) and the procedure loops back to S801.

FIG. 9 shows the buffer units of image buffer 109 and the flag buffer 114 after completing the logical sum calculations by repeating steps S801 to S803. The hatched areas in FIG. 9 indicate words including at least one "1" bit and, thus, represent print head positions at which one or more nozzles of one or more nozzle arrays need to be driven. The logical sums of the hatched areas in the buffer units are calculated with the words shifted relative to one another as shown in FIG. 9. As in the first embodiment above, the values R[i] stored in the hatched areas in flag buffer 114 indicate positions at which one or more of the printing elements are to be driven.

After repeating steps S801 to S803, variable i is cleared to 0 (zero) (step S804), and step S805 detects whether R[i]=0. If R[i]=0 (step S805 returns Yes), variable i is incremented by 1 (step S806) and step S807 detects whether i<2840+60. If it is (step S807 returns Yes), the procedure loops back to S805.

However, if R[i]≠0 (step S805 returns No), the current value if i represents the stroke start position and is stored in start position memory 120 as one end of the print head's stroke (movement range) (step S808).

Index i is then set to 2840+60 (step S809) and is then decremented by 1 (step S810), following which step S811 detects whether R[i]=0. If it is (step S811 returns Yes), the procedure loops back to S810. If R[i]≠0 (step S811 returns No), the current value of i represents the stroke stop position and is stored in stop position memory 121 as the other end of the print head's stroke (step S812). The process then ends.

On the other hand, if i≧2840+60 in step S807 (step S807 returns No), a value indicating that it is not necessary to move the print head 110 is stored in both memories 120 and 121 (step S814), and this process ends. Step s814 is the same as step S414 in FIG. 4 which is referred to, therefore.

Because the stroke start and stop positions in this second embodiment of the invention obtained by taking account of the nozzle array offset, these values directly express print head positions across the width of the paper. As a result, a printer according to this second embodiment can control print head movement even more efficiently than can a printer according to the first embodiment. This will be explained with reference to a simple example. Suppose only nozzle array 204 needs to print in the dot position column i=0. In such case, the line start position in the first embodiment would be 0, whereas the stroke start position in the second embodiment would be 60. Hence, the required print head stroke in the second embodiment could be shorter by 60 dot position columns.

Modifications of the First and Second Embodiments

The preceding first and second embodiments of the invention were described as using the arithmetic and logic unit (ALU) of the CPU 102 to perform logic operations, but these logic operations can also be accomplished using an electronic circuit such as a specialized gate array. More particularly, the logic operations accomplished for each dot position column or print head position, respectively, are independent of one another. A higher processing speed can therefore be achieved by performing these logic operations in parallel rather than sequentially, or in any combination of a parallel and a sequential processing.

Furthermore, the above embodiments were described as first storing the results of the logic operation in flag buffer 114 and determining the start and stop positions by searching sequentially to detect the smallest and the largest value of i for which R[i]≠0 (R[i]=0, if "0" indicates a dot to be printed). The invention can be alternatively comprised, however, to detect the start and stop positions without using flag buffer 114. More specifically, it is also possible to obtain R[i], based on the calculation of either the first or the second embodiment, while i, starting with one end value (e.g., i=0) is sequentially changed (e.g., incremented) until a value of i is reached for which R[i]≠0. Only this detected value of i is stored as one end position (e.g. the start position), whereas the results of the individual logical operations are not stored. The procedure is then repeated, this time starting the calculations from the other end value of i (e.g., 2839 in the first embodiment and 2899 in the second embodiment) to obtain the other end position (e.g., the stop position) in a similar way.

As has been described above, in one embodiment the present invention may be defined as a printer comprising: scanning means (111, 112) for causing a print head (110) to scan a printing medium (113) in a first direction (B) and a second direction (A) substantially orthogonal to each other, to print lines of dot matrix patterns on the printing medium by means of printing elements arranged on the print head in N arrays (201204) spaced apart from one another in said first direction, wherein said scanning defines lines of dot position columns on said printing medium (113), the lines extending in said first direction and the columns extending in said second direction, such that in each position of said print head (110) each of said N arrays faces a respective one of N dot positions columns; image storage means (109) for storing image information representing a line of dot matrix patterns, the image storage means comprising N storage units (109K–109Y) each associated with a respective one of said N arrays (201–204) and each storing for each of said dot position columns a respective image data word composed of drive data for controlling the printing elements in the associated array (201–204), said drive data having either an active or an inactive state, the active state indicating a dot is to be printed by the corresponding printing element and the inactive state indicating a dot is not to be printed; a logic device (102) for performing a logic operation on N image data words, one from each of said N storage units (109K–109Y), the result (K[i]) of said logic operation indicating whether at least one of said N image words contains active drive data; a movement range calculator (102) for obtaining, from the results (K[i]) of said logic operations, movement range information defining a movement range for the print head in said first direction to print the line of dot matrix patterns represented by said image information; and a controller (102) for driving said scanning means (111, 112) to move the print head (110) in accordance with said movement range.

There is one particular implementation of this printer, wherein said N image data words correspond to the same dot position column and said movement range calculator (102) is adapted to obtain initial movement range information from the results (K[i]) of said logic operations, and to modify the initial movement range information to obtain final movement range information, such that movement range defined by the final movement range information is greater than that defined by the initial movement range information by a number of dot position columns equivalent to the distance between the two outermost ones (201, 204) of said N arrays.

There is another particular implementation of this printer wherein said n image data words correspond to the same print head position in said first direction.

In both of these particular implementations said movement range calculator (102) is adapted to obtain first and second end positions defining the minimum movement range the print head (110) is required to scan in said first direction to print the line of dot matrix patterns represented by said image information. The printer further result storage means (114) for storing the results (K[i]) of said logical operations, wherein said movement range calculator (102) is adapted to obtain said movement range information by scanning the results stored in said result storage means (114).

What is claimed is:

1. A printer comprising:

a printing medium transport section for transporting a printing medium;

a print head having a plurality of printing element arrays disposed thereto with a specific offset distance therebetween, each printing element array having a plurality of printing elements;

a head transport unit for moving the print head orthogonally to the direction in which the paper transport section transports the printing medium;

a plurality of image data storage units disposed in correlation to the plural printing element arrays for storing with correlation to a dot column position in the print head scanning direction drive data indicative of whether a printing element is driven or non-driven;

a logic device for performing a logic operation on drive data stored in plural image data storage units correlated to the print head movement position, and calculating logic operation results for each print head movement position, said logic operation results indicative of whether at least one drive data for the print head movement position contains print-on data for driving one of the printing elements;

a print head movement range calculator for obtaining print head movement range information defining a print head movement range required to print the drive data stored in an image data storage unit based on the logic operation results from the logic device; and a movement controller for driving the head transport unit to move the print head in the print head movement range identified from the print head movement range information calculated by the print head movement range calculator.

2. A printer as described in claim 1, wherein the logic device performs a logic operation on all drive data stored in the plural image data storage units correlated to the print head movement position in dot column units to calculate logic operation results for each print head movement position indicating if at least one of the drive data for that dot column is print-on data; and the print head movement range calculator determines the print head movement range by compensating the print head movement range detected from the logic operation results obtained by the logic device for the offset of the printing element array.

3. A printer as described in claim 2, wherein the print head movement range calculator compensates for the offset by adding the maximum offset between the plural printing element arrays to the print head movement range detected from the logic operation results by the logic device.

4. A printer as described in claim 1, wherein the logic device performs sequential logic operations on drive data stored in the plural image data storage units at each dot column position from one end in the direction of print head movement to calculate logic operation results; and the print head movement range calculator sequentially monitors the logic operation results sequentially calculated by the logic device, and obtains as one end of the print head movement range the dot column position at which a logic value indicating the presence of said print-on data first appears.

5. A printer as described in claim 4, wherein the logic device performs sequential logic operations on drive data stored in the plural image data storage units at each dot column position from another end on the side opposite the one end of the print head movement range to calculate logic operation results; and the print head movement range calculator monitors the logic operation results sequentially output by the logic device, and obtains the other end of the print head movement range by correlating to the offset amount the dot column position at which a logic value indicating the presence of said print-on data first appears.

6. A printer as described in claim 1, further comprising operation results storage for storing the logic operation results obtained by the logic device, and characterized by the print head movement range calculator obtaining position information for at least one end of the print head movement range in the print head scanning direction by search-scanning data stored in the operation results storage in correlation to a dot position in the print head movement direction.

7. A printer as described in claim 6, wherein information stored in the operation results storage is stored as logic value array data indexed to a dot column position in the valid printing range of the print head, and the print head movement range calculator defines as one end of the print head movement range the position corresponding to the index whereat a logic operation result indicating presence of said print-on data first appears when search-scanning the logic value array data from one end.

8. A printer as described in claim 7, wherein the print head movement range calculator scans the logic value array data stored in the operation results storage from the other end, and defines as the other end of the print head movement range a position obtained by compensating for the offset amount a position corresponding to the index whereat a logic operation result indicating presence of said print-on data first appears.

9. A printer as described in claim 1, wherein the logic device compensates drive data for each dot column position stored in the plural image data storage units according to the offset of each printing element array, performs a logic operation on the compensated drive data correlated to a print head position, and calculates logic results information indicative of whether print-on data for driving at least one of the plural printing elements of the plural printing element arrays is present at a particular dot column position as a logic value compensated for the printing element array offset at each print head movement position.

10. A printer as described in claim 9, wherein the logic device performs sequential logic operations on drive data compensated for the offset between each printing element array at each dot column position from another end on the side opposite the one end of the print head movement range; and the print head movement range calculator sequentially monitors the logic operation results sequentially calculated by the logic device, and obtains as one end of the print head movement range the dot column position at which a logic value indicating print-on data presence first appears.

11. A printer as described in claim 10, wherein the logic device performs sequential logic operations on drive data compensated for the offset between each printing element array at each dot column position from another end on the side opposite the one end of the print head movement range; and the print head movement range calculator monitors the logic operation results sequentially output by the logic device, and obtains as the other end of the print head movement range the dot column position at which a logic value indicating print-on data presence first appears.

12. A printer as described in claim 9, further comprising operation results storage for storing the logic operation results obtained by the logic device correlated to a dot column position in the print head scanning direction and the offset amount, and characterized by the print head movement range calculator obtaining dot column position information for at least one end of the print head movement range in the print head scanning direction by search-scanning data stored in the operation results storage correlated to a dot column position of the print head in the print head scanning direction.

13. A printer as described in claim 12, wherein information stored in the operation results storage is stored as logic value array data indexed to a dot column position in the valid printing range of the print head including the offset amount, and the print head movement range calculator defines as one end of the print head movement range the position corresponding to the index whereat a logic operation result indicating print-on data presence first appears when search-scanning the logic value array data from one end.

14. A printer as described in claim 13, wherein the print head movement range calculator scans the logic value array data from the other end, and defines as the other end of the print head movement range the position corresponding to the index whereat a logic operation result indicating print-on data presence first appears.

15. A printer as described in claim 9, wherein the logic device compensates for the offset amount by defining one of the plural printing element arrays as a reference printing element array correlated to a specific dot column position, and adds or subtracts a dot count equivalent to a physical offset from the reference printing element array, and calculates logic operation results at each print head movement position indicating whether the drive data corresponding to the print head movement position contains at least one print-on data by calculating as a compensated dot column position the position of a drive data array physically printable by a respective printing element array when the reference printing element array is at a dot position, and applying a logic operation to the reference printing element array drive data and drive data corresponding to the compensated dot column position stored in the image data storage units for the plural printing element arrays other than the reference printing element array.

16. A printer as described in claim 1, wherein the print head is an inkjet head, and the plural printing elements are inkjet nozzles.

17. A printer as described in claim 1, wherein the printing element arrays of the print head correspond to different colors, and are printing element arrays capable of at least four-color printing using cyan, yellow, magenta, and black.

18. A printer as described in claim 17, wherein the printer has a control circuit consisting primarily of a CPU, ROM, and RAM; and the image data storage unit for each color has operation results memory comprising a plurality of word-length buffers for storing data in CPU data processing units so that logic operations are performed on data in the image buffers for each color in data processing units correlated to a print head position, and the logic operation results are stored in the CPU data processing unit.

19. A printer as described in claim 18 wherein there are 32 or more printing elements per color, and the CPU is a CPU with a 16-bit or 32-bit data processing unit.

20. A printer as described in claim 1, wherein drive data in the image data memory for storing printing element drive data is set to 1 to indicate a driven printing element and 0 to indicate a non-driven printing element, and the logic operation of the logic device is a logical OR operation.

21. A printer as described in claim 1, wherein drive data in the image data memory for storing printing element drive data is set to 0 to indicate a driven printing element and 1 to indicate a non-driven printing element, and the logic operation of the logic device is a logical NAND operation.

22. A printing method in a printer having a data receiver for receiving print data from an external source, image data memory for storing data correlating the data received by the data receiver to the plural printing elements and indicating whether a printing element is driven, a printing medium transport section for transporting a printing medium, and a plurality of printing element arrays disposed with a specific offset therebetween, each printing element array corresponding to one of plural colors and having a plurality of printing elements, a print head for printing text or image on a printing medium transported by the printing medium transport section by driving the printing element arrays, and a head transport unit for moving the print head in a print head scanning direction orthogonal to the transport direction of the printing medium transported by the printing medium transport section, the printing method comprising:

an image data storage step for storing in a plurality of image data storage units each corresponding to a plurality of printing elements drive data indicating whether a corresponding printing element is driven or not driven, said drive data being correlated to a position of an printing element array on the print head;

a logic operation step for performing a logic operation on data stored in the plurality of image data storage units with correlation to a position of a printing element array on the print head to obtain information indicative of whether any one of the plural printing elements is driven at the print head position;

a print head movement range calculating step for identifying from the information obtained by the logic operation step a first position from at least one end in the print head scanning direction at which at least one printing element is driven, and obtaining a range in which the print head should be moved for printing; and a print head moving step for moving the print head in the detected print head movement range.

23. A printing method as described in claim 22 wherein the printer further comprises operation results storage for storing the logic operation results obtained by the logic operation step, and the printing method further comprises:

a flag storing step for storing logic operation results as a logic value array; and a print head movement range calculating step for search-scanning the stored logic value array from an end of the operation results storage to identify a position at at least one end of the print head movement range where at least one printing element is driven.

24. A printing method as described in claim 22, wherein the print head movement range calculating step has a print head moving step for identifying, in addition to the one end position, a first position whereat at least one printing element is driven, or a last position whereat at least one printing element is driven, from another end, and obtains a range in which the print head is moved for printing, and moving a printing element array of the print head in the obtained range.

25. A data storage medium carrying a computer-readable program implementing a printing method as described in any of claims 22 to 24.

26. A computer program product of a printing method comprising an executable command set of the steps described in any of claims 22 to 24.

27. A printer comprising:

a print head for printing on a print media, said print head being movable within a predefined print region, said print region being divided into a predefined number of consecutive print sub-regions;

a first image buffer including a plurality of first print data storage units having a one-to-one correspondence with said print sub-regions, each of said first print data storage units containing first print data for printing within its corresponding print sub-region, said first image buffer containing a first predefined logic marker within first print data storage units corresponding to print sub-regions wherein no printing is desired;

a second image buffer including a plurality of second print data storage units having a one-to-one correspondence with said print sub-regions, each of said second print data storage units containing second print data for printing within its corresponding print sub-region, said second image buffer containing a second predefined logic marker within print data storage units corresponding to print sub-regions wherein no printing is desired, said first and second logic markers being applicable to a predefined logic combination to produced a third predefined logic marker;

a print location indicator for identifying a first target print sub-region among said consecutive print sub-regions defined as a print sub-region requiring printing and whose adjacent print sub-regions extending to a chosen end of said print region all require no printing, said print location indicator including a logic unit for implementing said predefined logic combination on data contents of the first print data storage unit and the second print data storage unit corresponding to a print sub-region under inspection and noting when the result of said predefined logic combination is not said predefined third logic marker.

28. The printer of claim 27, wherein said logic unit cycles through said first and second image buffers in an order corresponding to a sequential walkthrough of consecutive print sub-regions within said print region.

29. The printer of claim 28, wherein said logic unit ends its current walkthrough of consecutive print sub-regions upon identifying a first and second print data storage unit pair whose result to said predefined logic combination is not said predefined third logic marker;

said first target print sub-region being the print sub-region corresponding to said identified first and second print data storage unit pair whose predefined logic combination is not said predefined third logic marker.

30. The printer of claim 29, wherein each of said print sub-regions has an associated index identifier, and the index identifier of said first target print sub-region is stored in memory.

31. The printer of claim 30, wherein said print location indicator initiates a second sequence for identifying a second target print sub-region among said consecutive print sub-regions defined as a print sub-region requiring printing and whose adjacent print sub-regions extending to an end of said print region opposite said chosen end all require no printing;

said logic unit responding to said second sequence by initiating a second cycling process through said first and second image buffers in an order corresponding to a sequential walkthrough of consecutive print sub-regions within said print region from said opposite end toward said chosen end.

32. The printer of claim 31, wherein said logic unit ends its second cycling process upon identifying a first and second print data storage unit pair whose result to said predefined logic combination is not said predefined third logic marker;

said second target print sub-region being the print sub-region corresponding to this first and second print data storage unit pair whose predefined logic combination is not said predefined third logic marker as identified during said second cycling process.

33. The printer of claim 32, wherein the index identifier of said second target print sub-region is stored in memory.

34. The printer of claim 32, wherein said print head prints on a line-by-line basis and said print location indicator identifies the first and second target print sub-regions corresponding to the printable line subsequent to the current print line;

said printer further including a print head movement control for comparing the distance from the current print head position to either of said first second target print sub-regions and advancing said print head to the closer of the two target print sub-regions.

35. The printer of claim 27, wherein said first and second logic markers are the same.

36. The printer of claim 35, wherein said first and second logic markers are logic 0's.

37. The printer of claims 27 wherein said predefined logic combination is one of a logic OR and a logic NAND operation.

38. The printer of claim 27, wherein each of said print sub-regions has an associated index identifier, and the index identifier of said first target print sub-region is stored in memory.

39. The printer of claim 27, wherein the results of said predefined logic combination implemented by said logic unit are stored in a results buffer, and said print location indicator identifies said first target print sub-region by consecutively inspecting the contents of said results buffer until a location is found wherein the results of said predefined logic operation are not said predefined third logic marker.

40. The printer of claim 39, wherein each of said print sub-regions has an associated index identifier and said results buffer has a plurality of storage locations with a one-to-one correspondence with said index identifiers.

41. The printer of claim 39, wherein said logic unit cycles through said first and second image buffers in an order corresponding to a sequential walkthrough of consecutive print sub-regions within said print region.

42. The printer of claim 27, wherein said predefined print region defines a line of printable space orthogonal to the advancement direction of said print media.

43. A printing method comprising the steps of:

providing a print head for printing on a print media, said print head being movable within a predefined print region, said print region being divided into a predefined number of consecutive print sub-regions;

providing a first image buffer including a plurality of first print data storage units having a one-to-one correspondence with said print sub-regions, each of said first print data storage units containing first print data for printing within its corresponding print sub-region;

storing a first predefined logic marker within first print data storage units of said first image buffer corresponding to print sub-regions wherein no printing is desired;

providing a second image buffer including a plurality of second print data storage units having a one-to-one correspondence with said print sub-regions, each of said second print data storage units containing second print data for printing within its corresponding print sub-region;

storing a second predefined logic marker within second print data storage units of said second image buffer corresponding to print sub-regions wherein no printing is desired, said first and second logic markers being selected such that when applied to a predefined logic combination the result is a third predefined logic marker;

providing a logic unit for identifying a first target print sub-region among said consecutive print sub-regions defined as a print sub-region requiring printing and whose adjacent print sub-regions extending to a chosen end of said print region all require no printing, using said logic unit to implement said predefined logic combination on data contents of the first print data storage unit and the second print data storage unit corresponding to a print sub-region under inspection and noting when the result of said predefined logic combination is not said predefined third logic marker.

44. The method of claim 43, wherein said logic unit is made to cycle through said first and second image buffers in an order corresponding to a sequential walkthrough of consecutive print sub-regions within said print region.

45. The method of claim 44, wherein said logic unit ends its current walkthrough of consecutive print sub-regions upon identifying a first and second print data storage unit pair whose result to said predefined logic combination is not said predefined third logic marker;

said first target print sub-region being the print sub-region corresponding to said identified first and second print data storage unit pair whose predefined logic combination is not said predefined third logic marker.

46. The method of claim 45, wherein each of said print sub-regions is assigned an associated index identifier, and the index identifier of said first target print sub-region is stored in memory.

47. The method of claim 46, further having the step of initiating a second sequence for identifying a second target print sub-region among said consecutive print sub-regions defined as a print sub-region requiring printing and whose adjacent print sub-regions extending to an end of said print region opposite said chosen end all require no printing;

said logic unit being made to respond to said second sequence by initiating a second cycling process through said first and second image buffers in an order corresponding to a sequential walkthrough of consecutive print sub-regions within said print region from said opposite end toward said chosen end.

48. The method of claim 47, wherein said logic unit is made to end its second cycling process upon identifying a first and second print data storage unit pair whose result to said predefined logic combination is not said predefined third logic marker;

said second target print sub-region being the print sub-region corresponding to this first and second print data storage unit pair whose predefined logic combination is not said predefined third logic marker as identified during said second cycling process.

49. The method of claim 48, wherein the index identifier of said second target print sub-region is stored in memory.

50. The method of claim 48, wherein said print head prints on a line-by-line basis and said logic unit identifies the first and second target print sub-regions corresponding to the printable line subsequent to the current print line;

said method further including a step of comparing the distance from the current print head position to either of said first second target print sub-regions and advancing said print head to the closer of the two target print sub-regions.

51. The method of claim 43, wherein said first and second logic markers are selected to be the same.

52. The method of claim 51, wherein said first and second logic markers are assigned logic 0's.

53. The method of claims 43 wherein said predefined logic combination is selected to be one of a logic OR and a logic NAND operation.

54. The method of claim 43, wherein each of said print sub-regions is assigned an associated index identifier, and the index identifier of said first target print sub-region is stored in memory.

55. The method of claim 43, wherein the results of said predefined logic combination implemented by said logic unit are stored in a results buffer, and said first target print sub-region is identified by consecutively inspecting the contents of said results buffer until a location is found wherein the results of said predefined logic operation are not said predefined third logic marker.

56. The method of claim 55, wherein each of said print sub-regions is assigned an associated index identifier and said results buffer is selected to have a plurality of storage locations with a one-to-one correspondence with said index identifiers.

57. The method of claim 55, wherein said logic unit is made to cycle through said first and second image buffers in an order corresponding to a sequential walkthrough of consecutive print sub-regions within said print region.

58. The method of claim 43, wherein said predefined print region defines a line of printable space orthogonal to the advancement direction of said print media.

* * * * *